US009220359B2

(12) United States Patent
Long

(10) Patent No.: US 9,220,359 B2
(45) Date of Patent: Dec. 29, 2015

(54) EXERCISE MAT

(71) Applicant: Raymond Long, Tampa, FL (US)

(72) Inventor: Raymond Long, Tampa, FL (US)

( * ) Notice: Subject to any disclaimer, the term of this patent is extended or adjusted under 35 U.S.C. 154(b) by 0 days.

(21) Appl. No.: 13/760,974

(22) Filed: Feb. 6, 2013

(65) Prior Publication Data

US 2013/0198953 A1 Aug. 8, 2013

Related U.S. Application Data

(60) Provisional application No. 61/633,288, filed on Feb. 7, 2012.

(51) Int. Cl.

| | |
|---|---|
| ***A47G 9/06*** | (2006.01) |
| ***A63B 21/00*** | (2006.01) |
| ***A63B 23/02*** | (2006.01) |
| *A63B 23/025* | (2006.01) |
| *A63B 23/00* | (2006.01) |

(52) U.S. Cl.

CPC ..... *A47G 9/06* (2013.01); *A63B 21/00047* (2013.01); *A63B 21/1473* (2013.01); *A63B 23/0216* (2013.01); *A63B 23/0238* (2013.01); *A63B 23/025* (2013.01); *A63B 2023/006* (2013.01); *A63B 2208/0271* (2013.01); *A63B 2209/00* (2013.01)

(58) Field of Classification Search

USPC ..... 5/417, 636, 648, 653; 482/130, 10, 142

See application file for complete search history.

(56) References Cited

U.S. PATENT DOCUMENTS

| | | | | | |
|---|---|---|---|---|---|
| 2,384,713 | A | * | 9/1945 | Varma | 297/452.26 |
| 2,795,802 | A | * | 6/1957 | Myers | 5/632 |
| 3,077,347 | A | * | 2/1963 | Nova | 482/142 |
| 4,057,240 | A | * | 11/1977 | Damico et al. | 5/611 |
| 4,367,870 | A | * | 1/1983 | Birch | 482/142 |
| 4,472,848 | A | * | 9/1984 | Newman | 5/81.1 T |
| 4,673,216 | A | * | 6/1987 | Alfer | 297/452.27 |
| 4,951,334 | A | * | 8/1990 | Maier | 5/653 |
| 4,998,301 | A | * | 3/1991 | Markus | 4/457 |
| 5,014,375 | A | * | 5/1991 | Coonrad et al. | 5/648 |
| 5,457,832 | A | | 10/1995 | Tatum | |
| 5,528,782 | A | * | 6/1996 | Pfeuffer et al. | 5/611 |
| 5,643,163 | A | * | 7/1997 | Chen | 482/142 |
| 5,675,853 | A | * | 10/1997 | Linge | 5/655 |

(Continued)

FOREIGN PATENT DOCUMENTS

| | | |
|---|---|---|
| CN | 201482069 | 5/2010 |
| FR | 2837396 A1 | 9/2003 |

(Continued)

*Primary Examiner* — Joseph W Sanderson

*Assistant Examiner* — Richard G Davis

(74) *Attorney, Agent, or Firm* — Proskauer Rose LLP

(57) ABSTRACT

An exercise mat for a person exercising on a floor surface comprises a pad having a top surface, a bottom surface, and a peripheral edge. A cutout is formed in a first portion of the peripheral edge and sized to accommodate the neck of the person. A high-friction non-slip texture or coating may be applied to either the top surface or the bottom surface of the pad, or both. The top surface may further includes a pair of raised shoulder stops. In use, with the bottom surface of the pad resting on the floor surface and with the person's shoulders supported on opposing sides of the cutout proximate the first portion of the peripheral edge, the person's neck may be positioned within the cutout to allow natural flexion curvature of the cervical spine when the person is performing a shoulder stand on the mat.

25 Claims, 5 Drawing Sheets

(56) References Cited

U.S. PATENT DOCUMENTS

| | | | | |
|---|---|---|---|---|
| 6,553,995 | B1 * | 4/2003 | Cole et al. | 128/846 |
| 7,194,778 | B2 * | 3/2007 | Riach | 5/735 |
| D604,422 | S * | 11/2009 | Albrecht et al. | D24/183 |
| 7,966,679 | B2 * | 6/2011 | Sakata et al. | 5/653 |
| 2002/0184707 | A1 * | 12/2002 | Stevens | 5/640 |
| 2008/0092296 | A1 * | 4/2008 | Guez | 5/636 |
| 2009/0056016 | A1 * | 3/2009 | Zack et al. | 5/417 |
| 2009/0211031 | A1 * | 8/2009 | Kloes et al. | 5/640 |
| 2012/0009377 | A1 * | 1/2012 | Dodge et al. | 428/90 |
| 2012/0180220 | A1 * | 7/2012 | Popitz | 5/638 |
| 2013/0098364 | A1 * | 4/2013 | Davis et al. | 128/206.21 |

FOREIGN PATENT DOCUMENTS

| | | |
|---|---|---|
| JP | 2000328321 A | 11/2000 |
| RU | 38558 | 7/2004 |
| RU | 110242 | 11/2011 |

* cited by examiner

EXERCISE MAT

CROSS-REFERENCE TO RELATED APPLICATIONS

This application claims the benefit of U.S. Provisional Patent Application 61/633,288, filed on Feb. 7, 2012, and which is incorporated herein by reference.

STATEMENT REGARDING FEDERALLY SPONSORED RESEARCH AND DEVELOPMENT

Not Applicable.

FIELD OF THE INVENTION

This invention relates to exercise and stretching devices, and more particularly to an ergonomic yoga mat.

DISCUSSION OF RELATED ART

Shoulder Stand or, in Sanskrit, "Sarvangasana" and its variations are common poses used in the practice of yoga and also Pilates. There are recently published cautions relating to this pose that encourage placing a firm support underneath the lower part of the neck, shoulders, upper arms and elbows, with the objective of preventing hyper flexion of the cervical spine.

The rationale for this is that raising the shoulders above the floor on several blankets or a foam plank allows the neck to extend somewhat, thereby theoretically removing stress on the interspinous ligaments of the neck. The instruction usually given is to fold several firm blankets and perform the pose with the shoulders and arms supported on the blankets while the head hangs over the edge.

This approach has a number of shortcomings that actually expose the practitioner to other hazards. First, the lower three cervical vertebrae (C5-C7) are at the level of the shoulders in this pose. Thus, performing the pose with a stack of blankets or plank under the shoulders necessarily also places the weight of the body on these lower cervical vertebrae. In this manner, rather than distributing the flexion curvature over the entire cervical spine, performing the pose while elevated on blankets or plank actually concentrates the body weight on the lower cervical vertebrae. At the same time, an unnatural curvature is produced in the upper levels of the cervical spine from the head hanging over the edge of the blankets so that the cervical spine is subjected to an "S" or sigmoidal type curvature with both flexion and extension taking place. Additionally, in order to hang the head over the edge of the blankets it is necessary to have the shoulders precipitously close to the edge of the blankets or plank. As a result, many practitioners accidentally slide off the blankets or plank resulting in a sudden, unexpected flexion moment on the cervical spine. This is especially true as the practitioner transitions from Shoulder Stand to Plow Pose (with the legs and feet lowered to the floor). The remedy for this is to place the shoulders and neck further onto the blankets or plank and away from the edge and allow only the very top cervical vertebrae and head to hang over the edge—or be completely on the blanket or plank. This defeats the purpose of raising the shoulders in the first place and can result in an even more abnormal curvature in the upper cervical spine.

Thus, the goal of performing a shoulder stand and its variations on a stack of blankets or plank—with the supposed benefit of removing some of the flexion from the cervical spine—is not accomplished by this commonly practiced technique. In fact, risk to the cervical spine is enhanced by the possibility of sliding off the blankets, concentrating curvature onto the lower cervical vertebrae, and producing an unnatural curve in the cervical spine.

Ergonomic pillows might conceivably be employed to provide clearance for the neck of a person while performing a shoulder stand, yet still support the person's shoulders above the floor surface. For example, U.S. Pat. No. 2,835,905 to Tomasson on Jun. 8, 1954 teaches a pillow with a cutout cut into one side. Likewise, U.S. Pat. No. 3,009,172 to Eidam on Jul. 27, 1959 teaches a head supporting pillow with a cutout. However, the top surfaces of both of these prior art pillows are slanted in such a way as to make them unsuitable for stably supporting the shoulders of a person in a shoulder stand pose Further, such prior art pillows are not long enough to support the person's torso when beginning or ending such a pose, and in fact would be so short as to provide a risk of flipping dangerously on their front ends if used for such a purpose.

U.S. Pat. No. 5,457,832 on Oct. 17, 1995 to Tatum teaches a cervical pillow with variable thickness head and neck portions, and is designed for supporting a person's head and neck while sleeping in a reclined position. Such a device suffers from the same drawbacks as the previously-mentioned ergonomic pillows in that a person's shoulders would be dangerously unstable if used for aiding in a shoulder stand pose.

U.S. Pat. No. 7,707,668 to Kloes et al. on May 4, 2010 teaches an head supporting pillow with a neck cutout, but like the previously-mentioned patents such a device is not long enough to support the person's torso when beginning or ending such a pose, and the neck cutout is not shaped in such a way as to accommodate a person's neck comfortably while supported thereon and performing a shoulder stand pose.

U.S. Design Pat. No. D444,980 to Mowat et al. on Jul. 17, 2001 teaches an ergonomic pillow having a recessed portion in a front edge that could conceivably be used for supporting a person conducting a shoulder stand. However, such a device is shaped that it could dangerously flip up on its front edge during such use, and is also not long enough to support the person's torso when beginning or ending such a pose.

Therefore, there is a need for an exercise support pad that provides a suitably-shaped cutout in a front edge thereof for accommodating a person's neck while performing a shoulder stand pose. Such a needed device would be long enough to support the person's torso when beginning or ending such a pose, and provide means for inhibiting the person's shoulders from dangerously slipping off the front edge of the mat. Such a needed invention would be stable and designed not to flip over during use. The present invention accomplishes these objectives.

SUMMARY OF THE INVENTION

The present device is an exercise mat for a person exercising on a floor surface. The mat comprises a pad having a top surface, a bottom surface, and a peripheral edge. The shape of the pad may be rectangular, oval, square, or other shape as suited for the proper use of the mat. The pad is preferably made from a soft foam material.

A cutout is formed in a first portion of the peripheral edge and sized to accommodate the neck of the person. In one embodiment, the cutout is formed equally through the top and bottom surfaces of the pad. Alternately, the cutout is formed in the top surface of the pad to a depth greater than a depth formed in the bottom surface of the pad. As such, the peripheral edge of the pad at the cutout services to create a gentle curve in the cervical spine of the person appropriate for the shoulder stand pose.

In one embodiment, the cutout is formed in the top surface and the first portion of the peripheral edge of the pad but not through the bottom surface of the pad. The cutout may be defined, in one embodiment, by a pair of shoulder supporting projections projecting away from the first portion of the peripheral edge of the pad. The shape of the cutout may be a half-circle, a rectangle, a triangle, a half-oval, or other shapes provided the shoulders may be well supported on either side thereof without the neck of the person being bent as with the prior art devices.

In one embodiment a high-friction non-slip texture or coating is applied to either the top surface or the bottom surface of the pad, or both. In one embodiment, the top surface further includes a pair of raised shoulder stops proximate the first portion of the peripheral edge of the pad, which aids the prevention of the person's shoulders slipping off of the pad during the shoulder stand pose, which can result in neck and back injury. Additionally, shoulder troughs may be included proximate the first portion of the peripheral edge of the pad to aid in the prevention of the person's shoulders slipping off of the pad during the shoulder stand pose.

In use, with the bottom surface of the pad resting on the floor surface and with the person's shoulders supported on opposing sides of the cutout proximate the first portion of the peripheral edge, the person's neck may be positioned within the cutout to allow natural flexion curvature of the cervical spine when the person is performing a shoulder stand on the mat. This contrasts with the sharp, unnatural and dangerous bend in the cervical spine when using an exercise mat of the prior art. A pair of shoulder guides may be applied to the top surface of the pad to assist the person with proper alignment of his shoulders on the pad.

The present invention is an exercise support pad that provides a suitably-shaped cutout in a front edge thereof for accommodating a person's neck while performing a shoulder stand pose. The present invention is long enough to support the person's torso when beginning or ending such a pose, and provides means for inhibiting the person's shoulders from dangerously slipping off the front edge of the mat. The present invention is stable and designed not to flip over during use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
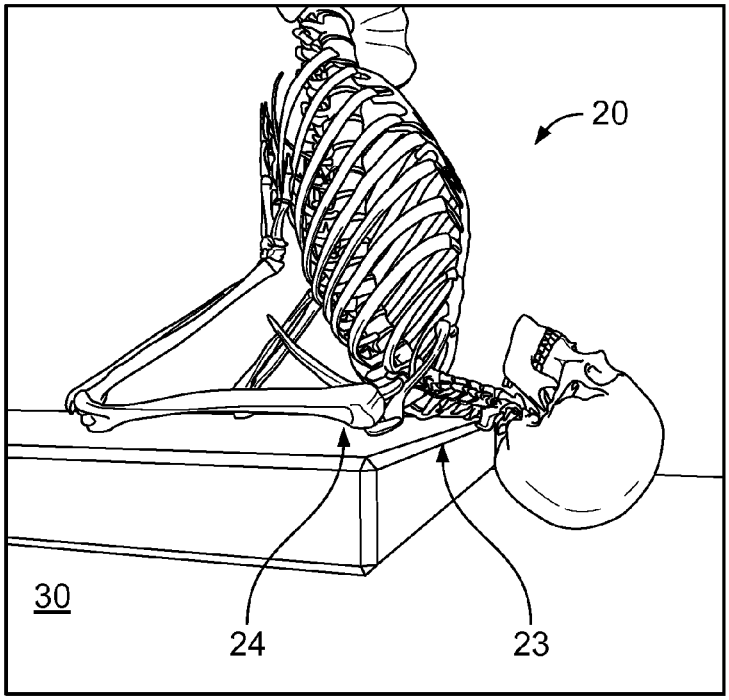
FIG. 1 (Prior Art)
FIG. 1 is a perspective diagram illustrating the prior art and the effect thereof on spine curvature for a person, represented by a skeleton, doing a shoulder stand.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 2-5 illustrate an exercise mat 10 for a person 20 exercising on a floor surface 30. The mat 10 comprises a pad 40 having a top surface 48, a bottom surface 42, and a peripheral edge 45. The pad 40 has an average height H and at least a first portion 50 of the peripheral edge 45 referred to generally in the illustrates as the front edge of the pad 40.

Figure 15:
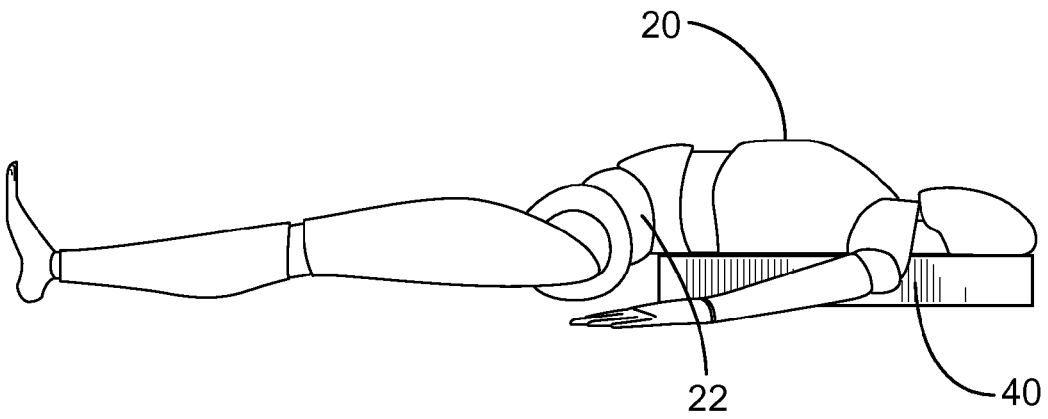
FIG. 15 is a left-side elevational diagram of a pad with an insufficient length to support the lumbar spine of the person.
Figure 16:
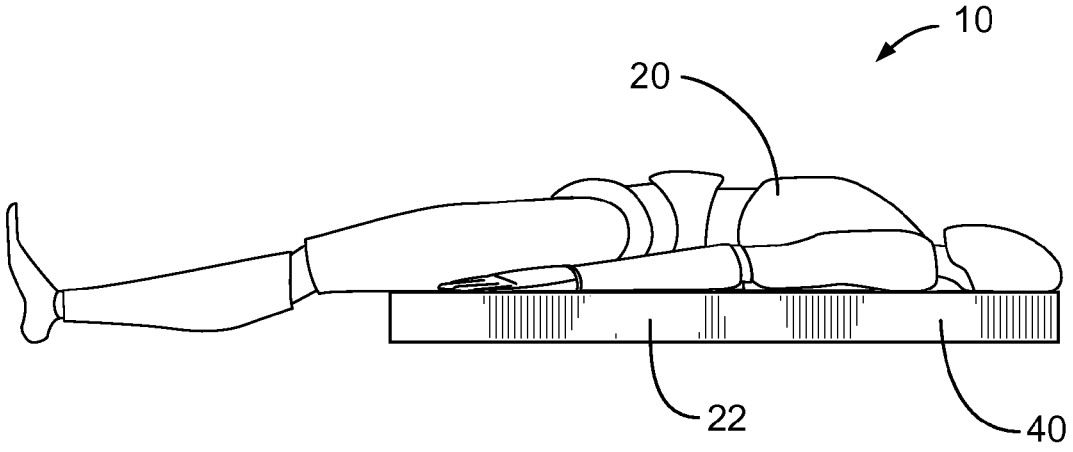
FIG. 16 is a left-side elevational diagram of a pad having a sufficient length to support the lumbar spine of the person.

The shape of the pad 40 is somewhat flexible in that the pad 40 may be a rectangular pad 80 (FIG. 3), an oval pad 90 (FIG. 8), a square pad 100 (FIG. 9), or other shapes as suited for the proper use of the mat 10. Certain dimensions of the pad 40 are preferred, such as the general height H (FIG. 5) of the pad 40 being between one and five inches, the width $W_1$ (FIG. 4) of the pad 40 being between 12 and 40 inches, and the length L of the pad 40 being between 15 and 50 inches, but preferably longer than 36 inches to reduce the risk of hyperextending the lumbar spine 22 when the person comes out of the shoulder stand position (FIGS. 15 and 16), and to accommodate the entire torso of the person 20 so that the sacrum is lowered onto the mat 10, rather than hyper extending the lumbar spine 22 while lowering out of the shoulder stand pose onto the floor 30.

The pad 40 is preferably made from a soft foam material, such as an EVA foam material having a hardness of between 20 and 40 shore C. The pad 40 is preferably not so soft that the weight of the person 20 compresses the pad 40 to a height of less than one or two inches, but preferably closer to three inches. The pad 40 may include a cover (not shown) made of a flexible fabric or other flexible material that is preferably machine washable, durable and comfortable to the touch, such as cotton.

Figure 6:
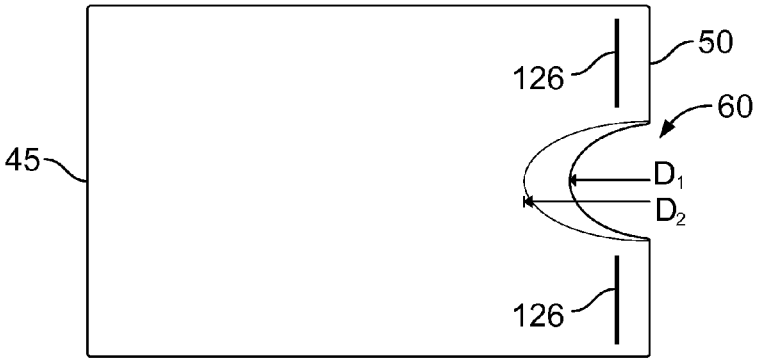
FIG. 6 is a top plan view of an alternate embodiment of the invention.

A cutout 60 is formed in the first portion 50 of the peripheral edge 45 and sized to accommodate the neck 25 of the person 20, preferably to a depth D of at least 6 inches (FIG. 13) and a width $W_2$ (FIG. 4) of between 6 and 10 inches. $W_2$ is necessarily not much wider, at a maximum, than the width of the person's head so as to ensure proper shoulder support of the person 20. In one embodiment, the cutout 60 is formed equally through the top and bottom surfaces 48,42 of the pad 40 (FIGS. 9-11 and 13). Alternately, the cutout 60 is formed in the top surface 48 of the pad 40 to a depth $D_2$ greater than a depth $D_1$ formed in the bottom surface 42 of the pad 40 (FIGS. 6, 8 and 12), where preferably $D_1$ is between 5 and 7 inches and $D_2$ is between 8 and 10 inches. As such, the peripheral edge 45 of the pad 40 at the cutout 60 services to create a gentle curve in the cervical spine 23 of the person 20 appropriate for the shoulder stand pose.

Figure 9:
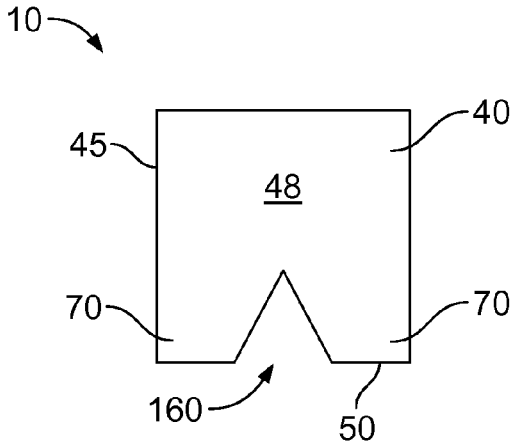
FIG. 9 is an embodiment having a triangular-shaped cutout.
Figure 10:
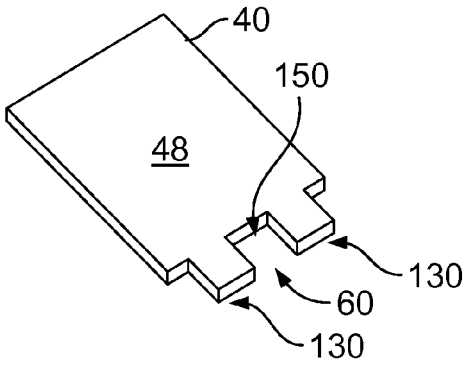
FIG. 10 is an embodiment having a pair of shoulder supporting projections.
Figure 11:
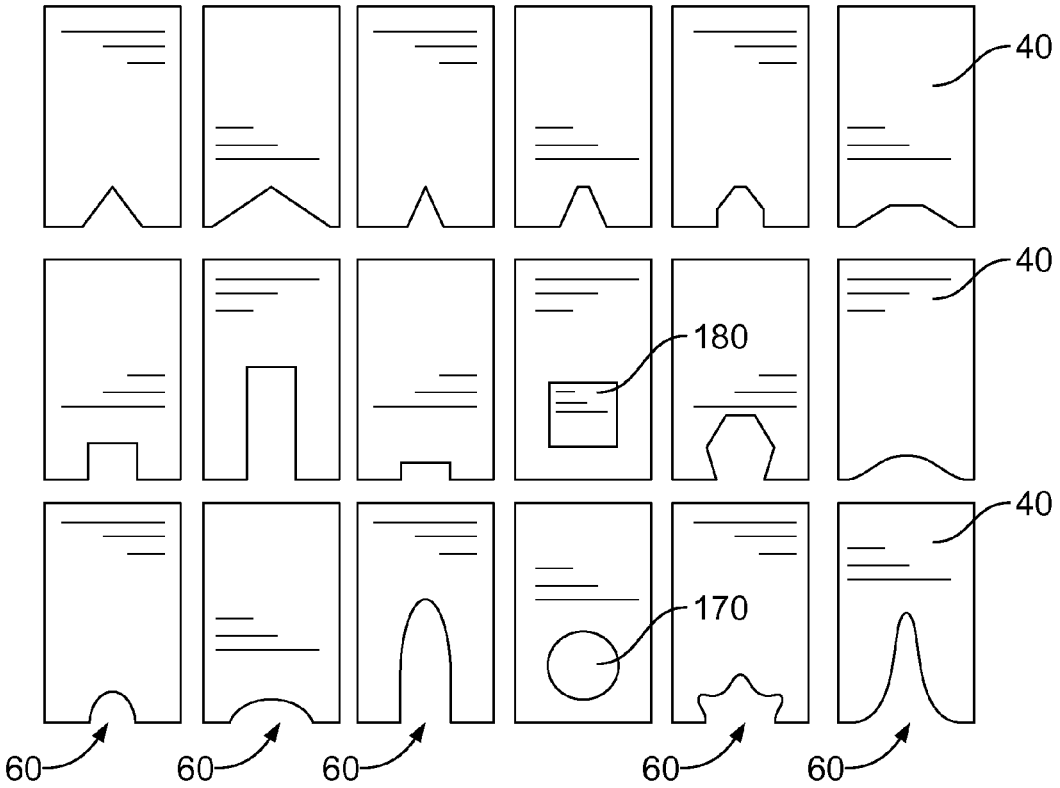
FIG. 11 is a top plan view of a set of alternate embodiments employing different shaped cutouts.
Figure 12:
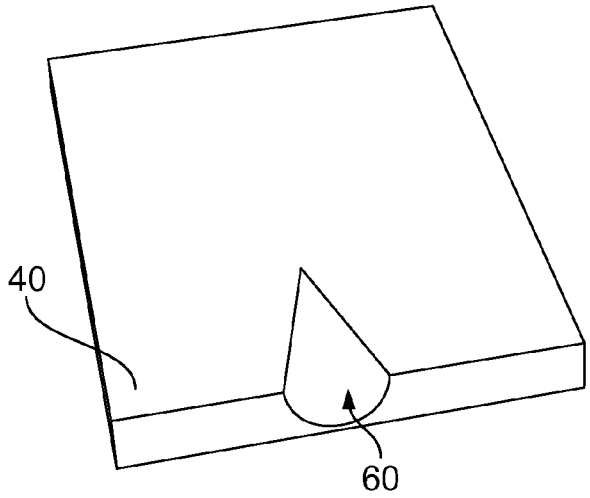
FIG. 12 is a perspective view of an embodiment having a conically-shaped cutout.
Figure 13:
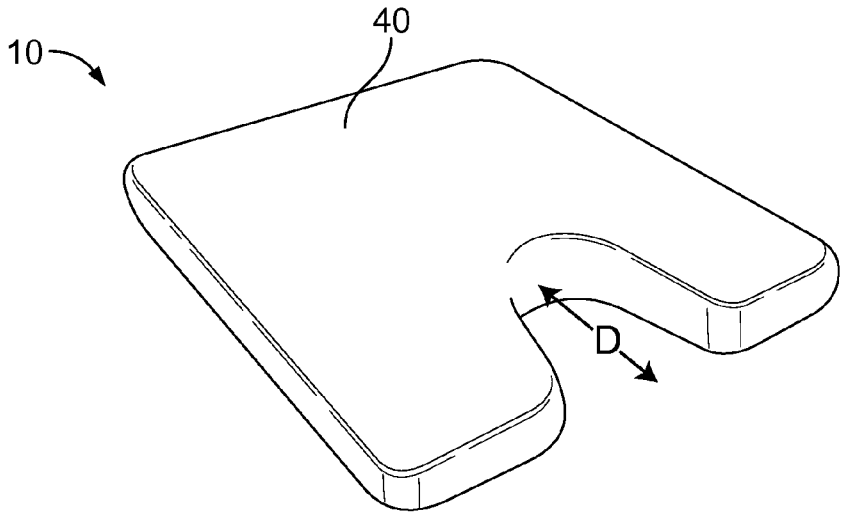
FIG. 13 is a perspective view of a pad having rounded edges.
Figure 14:
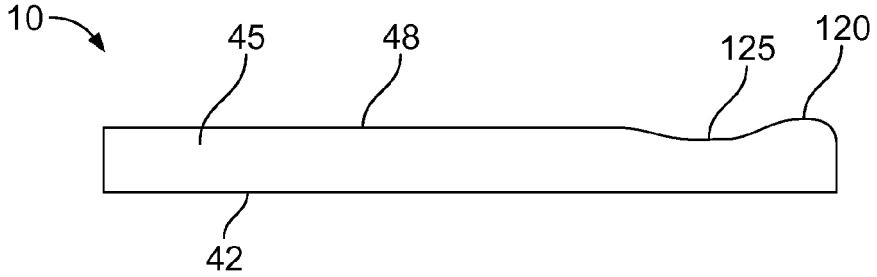
FIG. 14 is a left-side elevational view of an embodiment having shoulder troughs.

In one embodiment, the cutout 60 is formed in the top surface 48 and the first portion 50 of the peripheral edge 45 of the pad 40 but not through the bottom surface 42 of the pad 40 (FIG. 12). The cutout 60 may be defined, in one embodiment, by a pair of shoulder supporting projections 130 projecting away from the first portion 50 of the peripheral edge 45 of the pad 40 (FIG. 10). The shape of the cutout 60 may be a half-circle 140 (FIG. 8), a rectangle 150 (FIG. 10), a triangle 160 (FIG. 9), or a half-oval (FIG. 13). Other shapes as shown in FIG. 11, including cutouts 60 that are apertures 170 or recesses 180, may also be used, provided the shoulders 24 may be well supported on either side thereof without the neck 25 of the person 20 being bent as with the prior art devices.

Figure 7:
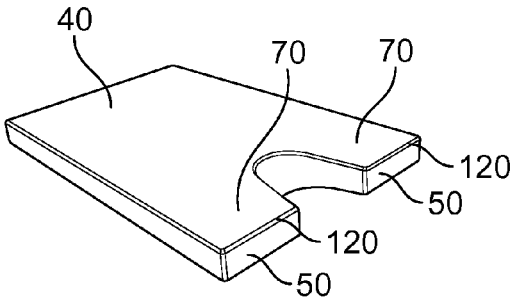
FIG. 7 is a perspective view of another alternate embodiment of the invention, illustrating a pair of shoulder stops thereof.
Figure 8:
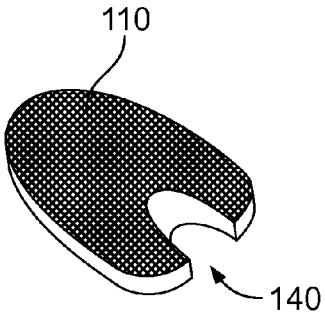
FIG. 8 is an embodiment having an oval-shaped pad.

In one embodiment a high-friction non-slip texture 110 or coating is applied to either the top surface 48 or the bottom surface 42 of the pad 40, or both (FIG. 8). In one embodiment, the top surface 48 further includes a pair of raised shoulder stops 120 (FIG. 7) proximate the first portion 50 of the peripheral edge 45 of the pad 40, which aids the prevention of the person's shoulders 24 slipping off of the pad 40 during the shoulder stand pose, which can result in neck and back injury. Additionally, shoulder troughs 125 may be included proximate the first portion 50 of the peripheral edge 45 of the pad 40 to aid in the prevention of the person's shoulders 24 slipping off of the pad 40 during the shoulder stand pose.

Figure 2:
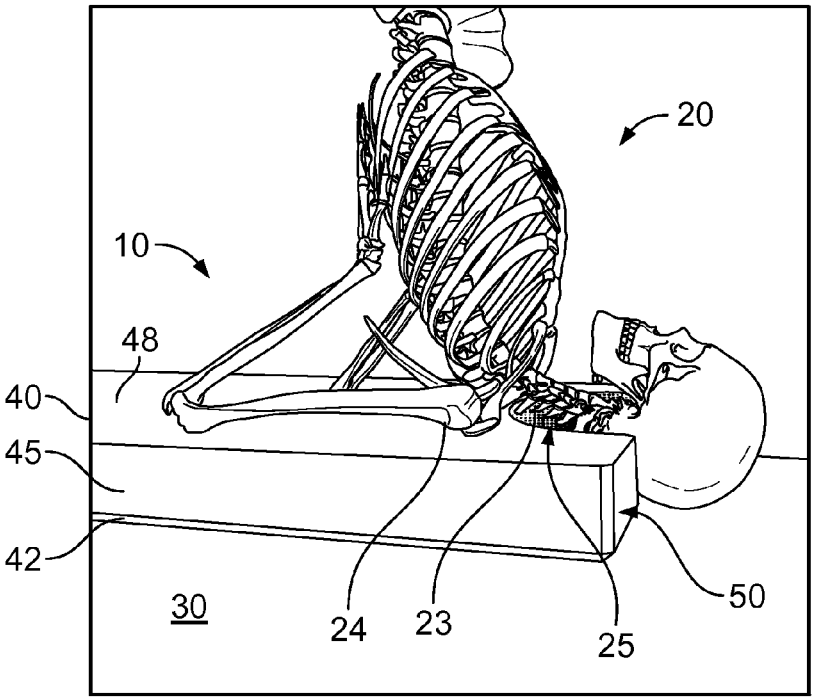
FIG. 2 is a perspective diagram illustrating the improved gradual curvature of the spine for those using the instant invention.
Figure 3:
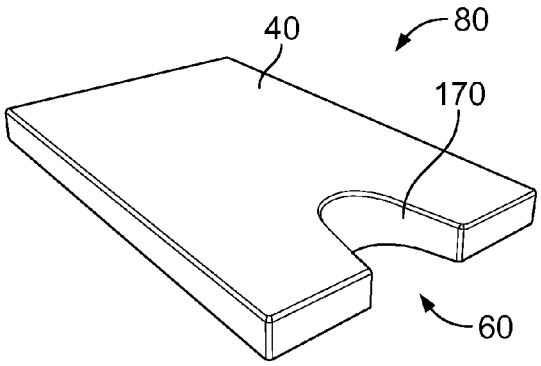
FIG. 3 is a perspective view of one embodiment of the invention.
Figure 4:
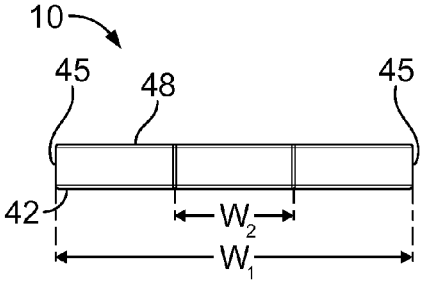
FIG. 4 is a front elevational view of FIG. 3.
Figure 5:
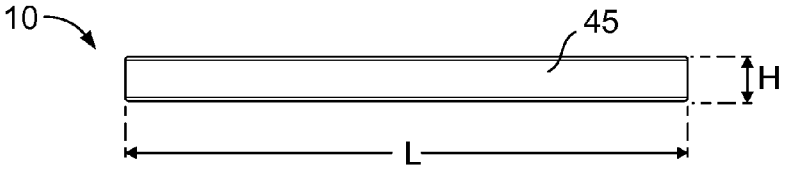
FIG. 5 is a side elevational view of FIG. 3.

In use, with the bottom surface 42 of the pad 40 resting on the floor surface 30 and with the person's shoulders 24 supported on opposing sides 70 of the cutout 60 proximate the first portion 50 of the peripheral edge 40, the person's neck 25 may be positioned within the cutout 60 to allow natural flexion curvature of the cervical spine 23 when the person 20 is performing a shoulder stand on the mat 10 (FIG. 2). This contrasts with the sharp, unnatural and dangerous bend in the cervical spine 23 when using an exercise mat of the prior art (FIG. 1). A pair of shoulder guides 126 (FIG. 6) may be applied to the top surface 48 of the pad 40 to assist the person 20 with proper alignment of his shoulders 24 on the pad 40. A separate foot plank or pad (not shown) may be further included to aid in dismounting from the shoulder stand pose to the so-called plow pose.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise mat for a person exercising on a floor surface, comprising:

a pad made from a foam material having a hardness of between 20 and 40 shore C for supporting the person while the person is performing a shoulder stand pose, the pad having a top surface, a bottom surface that is parallel to the top surface, and a peripheral edge, the pad having a height and at least a first portion of the peripheral edge; and a cutout formed in the first portion of the peripheral edge, wherein the cutout is sized to accommodate the neck of the person and has a width between 6 and 10 inches;

wherein with the bottom surface of the pad resting on the floor surface and with the person's shoulders supported on opposing sides of the cutout proximate the first portion of the peripheral edge, the person's neck may be positioned within the cutout to allow natural flexion curvature of the cervical spine when the person is performing a shoulder stand on the mat, and wherein the pad has a length of between 36 and 50 inches.

2. The exercise mat of claim 1 wherein the first portion of the peripheral edge is a first side of a rectangular pad.

3. The exercise mat of claim 2 wherein the first portion of the peripheral edge is a first side of a generally square pad.

4. The exercise mat of claim 1 wherein the cutout is formed equally through the top and bottom surfaces of the pad.

5. The exercise mat of claim 1 wherein the cutout formed in the top surface of the pad is larger than the cutout formed in the bottom surface of the pad.

6. The exercise mat of claim 5 wherein the cutout is formed in the top surface of the pad but not in the bottom surface of the pad.

7. The exercise mat of claim 5 wherein a depth of the cutout formed in the bottom surface is between 5 and 9 inches, and the depth of the cutout formed in the top surface is between 8 and 12 inches.

8. The exercise mat of claim 1 wherein the bottom surface includes a high-friction nonslip texture.

9. The exercise mat of claim 1 wherein the top surface includes a high-friction non-slip texture.

10. The exercise mat of claim 1 wherein the first portion of the peripheral edge is a first side of a generally oval pad.

11. The exercise mat of claim 1 wherein the top surface further includes a pair of raised shoulder stops proximate the first portion of the peripheral edge.

12. The exercise mat of claim 1 wherein the first portion of the peripheral edge includes a pair of shoulder supporting projections, the cutout being defined therebetween.

13. The exercise mat of claim 1 wherein the height of the pad is between one and five inches.

14. The exercise mat of claim 1 wherein the width of the first part of the peripheral edge is between 12 and 40 inches.

15. The exercise mat of claim 1 wherein the cutout is generally in the shape of a half circle.

16. The exercise mat of claim 1 wherein the cutout is generally in the shape of a rectangle.

17. The exercise mat of claim 1 wherein the cutout is generally in the shape of a triangle.

18. The exercise mat of claim 1 wherein the cutout is generally in the shape of a half oval.

19. The exercise mat of claim 1 wherein the cutout is formed into the pad at least to a depth of six inches.

20. The exercise mat of claim 1 wherein the top surface further includes a pair of recessed shoulder troughs proximate the first portion of the peripheral edge.

21. The exercise mat of claim 1 wherein the foam material comprises EVA foam.

22. The exercise mat of claim 21 wherein the pad has a hardness such that the weight of the person compresses the pad from a height that is greater than about three inches to a height of about three inches.

23. The exercise mat of claim 1 wherein the pad has a hardness such that the weight of the person compresses the pad from a height that is greater than about three inches to a height of about three inches.

24. An exercise mat for a person exercising on a floor surface, comprising:

a pad made from a foam material having a hardness of between 20 and 40 shore C for supporting the person while the person is performing a shoulder stand pose, the pad having a top surface, a bottom surface that is parallel to the top surface, and a peripheral edge, the pad having a height and at least a first portion of the peripheral edge; and a cutout formed in the first portion of the peripheral edge, wherein the cutout is sized to accommodate the neck of the person and has a width between 6 and 10 inches;

wherein with the bottom surface of the pad resting on the floor surface and with the person's shoulders supported on opposing sides of the cutout proximate the first portion of the peripheral edge, the person's neck may be positioned within the cutout to allow natural flexion curvature of the cervical spine when the person is performing a shoulder stand on the mat, and wherein the pad is sized to accommodate the entire torso of the person.

25. An exercise mat for a person exercising on a floor surface, comprising:

a pad made from a foam material having a hardness of between 20 and 40 shore C for supporting the person while the person is performing a shoulder stand pose, the pad having a top surface, a bottom surface that is parallel to the top surface, and a peripheral edge, the pad having a height and at least a first portion of the peripheral edge; and a cutout formed in the first portion of the peripheral edge, wherein the cutout is sized to accommodate the neck of the person and has a width between 6 and 10 inches;

wherein with the bottom surface of the pad resting on the floor surface and with the person's shoulders supported on opposing sides of the cutout proximate the first portion of the peripheral edge, the person's neck may be positioned within the cutout to allow natural flexion curvature of the cervical spine when the person is performing a shoulder stand on the mat, and wherein the pad is long enough to support the elbows of the person when the person is performing a shoulder stand on the mat with the person's neck positioned within the cutout.

* * * * *